United States Patent [19]

Brown

[11] 4,443,038

[45] Apr. 17, 1984

[54] MINERAL CUTTER TOOL HAVING WATER EMISSION DEFLECTION SURFACE

[75] Inventor: Henry M. Brown, Wendover, England

[73] Assignee: Anderson Strathclyde Limited, Buckinghamshire, England

[21] Appl. No.: 366,064

[22] Filed: Apr. 6, 1982

[30] Foreign Application Priority Data

Sep. 19, 1981 [GB] United Kingdom ..... 8128387

[51] Int. Cl.[3] ..... E21C 35/22

[52] U.S. Cl. ..... 299/81; 299/12; 299/17

[58] Field of Search ..... 299/12, 17, 81

[56] References Cited

U.S. PATENT DOCUMENTS

| | | | |
|---|---|---|---|
| 3,273,940 | 9/1966 | Belugou | 299/81 |
| 3,544,166 | 11/1968 | Proctor | 299/81 |
| 3,554,605 | 1/1971 | Elders | 299/92 |

FOREIGN PATENT DOCUMENTS

| | | | |
|---|---|---|---|
| 1274541 | 8/1968 | Fed. Rep. of Germany | 299/81 |
| 1062041 | 3/1967 | United Kingdom | 299/81 |
| 495437 | 12/1975 | U.S.S.R. | 299/81 |

*Primary Examiner*—Ernest R. Purser

*Attorney, Agent, or Firm*—Murray Schaffer

[57] ABSTRACT

A mineral cutter pick adapted to be mounted on a mineral mining machine and to cut during translational movement in an endless path thereon which pick comprises a body having a shank of circular cross section for accommodation in a correspondingly shaped recess on a support on a mineral cutting machine to mount the pick on the machine, said shank being adjacent its inner end not substantially less in diameter than at its outer end, the body having a forward end carrying a cutting tip and said body having a passage therethrough for liquid which passage leads from an inlet in the shank to at least one liquid outlet adjacent to the cutting tip.

9 Claims, 4 Drawing Figures

MINERAL CUTTER TOOL HAVING WATER EMISSION DEFLECTION SURFACE

DESCRIPTION

The invention relates to mineral cutter tools and more particularly but not exclusively to coal cutter picks of the kind adapted to be mounted on coal cutting machinery such as disc shearer drums, road heading machines or cutter chains.

It is now common practice in underground mining to provide water sprays close to the point of contact of the pick and the material being cut to suppress the formation of dust and to damp down possible sparking. It is known for the water spray to be supplied via a passage extending through the body of the pick and such arrangements are described in U.K. Patent Specification No. 1,144,340 of Austin Hoy & Company Limited and U.S. Pat. No. 3,273,940 of Charbonnages De France. Since it is usual for the picks to be replaceable most designs currently in use rely on some form of mechanical water seal, e.g. a rubber O-ring between the pick and its support to prevent, as far as possible, the escape of water other than through the passage leading to the water spray outlet.

The arrangements described in U.K. Patent Specification No. 1,144,340 necessitate the use of a wide pick body and consequently a wide cutter tip is required to cut clearance for the body. In some mining conditions wide cutter tips are undesirable and accordingly it is an object of the invention to provide an arrangement which permits the use of narrow cutter tips.

A serious disadvantage of known mineral cutter tools incorporating internal passages through which water is supplied to the cutter tip is that if the water outlet in the pick body becomes obstructed and the water pressure is maintained, there is a danger that the build up of water pressure will tend to force the tool from its support, which at best would reduce the efficiency of the mining machine and which could also constitute a hazard to safety. It is an object of the invention to provide an arrangement in which this danger is obviated.

The invention provides a mineral cutter pick adapted to be mounted on a mineral mining machine and to cut during translational movement in an endless path thereon which pick comprises a body having a shank of circular cross section for accommodation in a correspondingly shaped recess on a support on a mineral cutting machine to mount the pick on the machine, said shank being adjacent its inner end not substantially less in diameter than at its outer end the body having a forward end carrying a cutting tip and said body having a passage therethrough for liquid which passage leads from an inlet in the shank to at least one liquid outlet adjacent to the cutting tip. Preferably the shank is tapered so that it is frusto-conical in shape. Preferably the holder is arranged such that when the socket of the pick is mounted in the holder the free end of the pick shank is accessible so as to facilitate removal of the pick.

Preferably the water passage comprises a radial passage opening through the side wall of the shank the radial passage being arranged for alignment with a water passage extending into the socket in the holder. If desired the radial passage in the shank may have an enlarged portion where it emerges from the shank to improve ease of alignment or alternatively or additionally to accommodate a resilient sealing member e.g. a rubber O-ring if desired. The radial passage in the pick shank may communicate with a longitudinally extending passage in the pick shank which extends into the vicinity of the cutting tip and from the forward end of which one or more passages are arranged to emerge through the body of the pick adjacent to the cutter tip. For example one passage may be arranged to emerge from the pick body in front of the cutter tip and another may be arranged to emerge from the pick body immediately behind the cutting tip. If desired water issuing from the or each outlet adjacent to the cutting tip may be arranged to impinge on a surface of the pick body so that the stream of water is deflected and the formation of a spray enhanced. For this purpose the liquid outlet may be disposed in a groove formed in the pick body so that the stream of water impinges on one face of the groove.

From another aspect the invention comprises the combination of a mineral cutter pick as described above and a holder therefor.

The invention is diagrammatically illustrated by way of example in the accompanying drawings in which.

Figure 1:
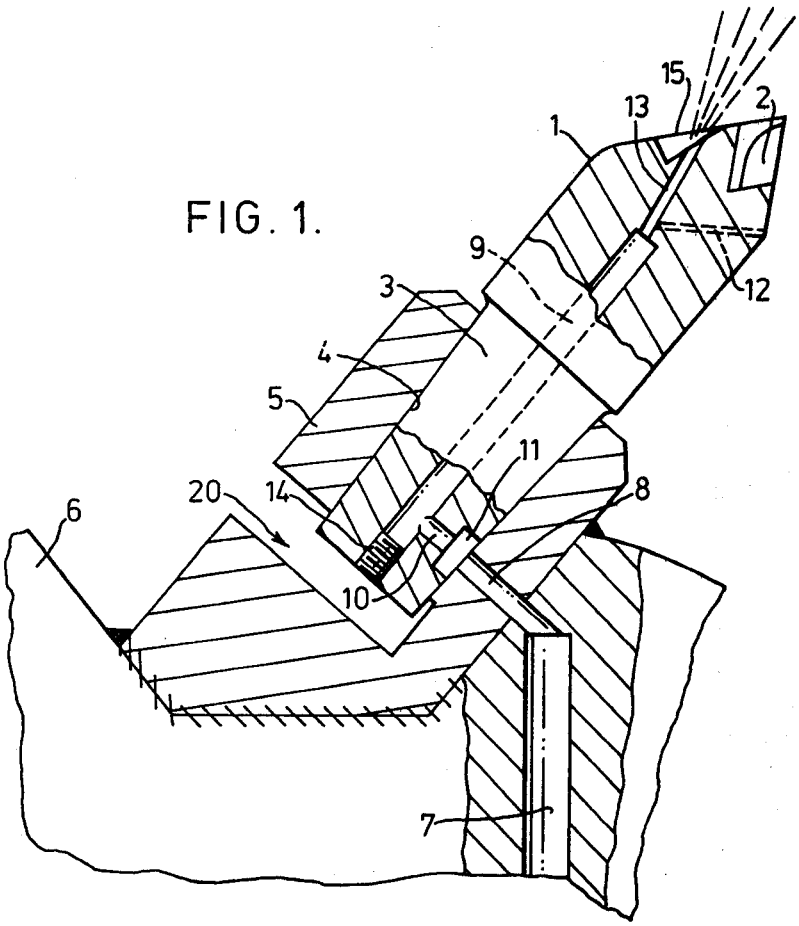
FIG. 1 is a cross sectional side elevation of a mineral cutter pick in accordance with the invention mounted in a holder on a mineral mining machine.

In the drawings there is shown a coal cutter pick comprising a body 1 formed at its forward end with a cutting tip 2 of a hard material such as tungsten carbide the body being formed with a frusto-conical shank 3 arranged for reception with a tight wedging fit in a correspondingly shaped socket 4 in a support 5 welded to the vane 6 of a mineral shearer drum not shown.

The inner end of the socket 4 of the holder 5 is terminated by a transverse slot 20 which extends through the holder to expose the rearward end of the shank 3 of a pick mounted in the holder. In this manner removal of the pick from the holder is facilitated since a tool, e.g. a wedge, may be engaged with the rear end of the pick to force it from the holder.

A water conduit 7 is provided extending through the vane of the mineral shearer drum which conduit connects with a conduit 8 which extends through the holder 5 and emerges into the socket 4. The mineral cutter pick 1 is formed with a radially extending bore in its shank 3 which bore communicates with the passage 8 in the holder and the radial bore 10 connects with a longitudinally extending bore 9 which extends forwardly into the vicinity of the cutting tip 2 and which communicates with bores 12 and 13 which emerge from the body of the pick near the front face and rear face respectively of the cutting tip 2. The rearward end of the bore 9 which may be formed by drilling is plugged as shown at 14. The radially outer end of the bore 10 may be enlarged as shown at 11 to facilitate alignment with the bore 8 and also perhaps to accommodate, if desired, resilient sealing means such as a rubber O-ring (not shown). It is thought that since the action of cutting forces on the pick is to tend to force the shank more firmly into the socket a sufficient seal will be provided by the mating faces of the shank and socket without the need for additional water sealing means. The passage 13 emerges from the pick body behind the cutting tip 2 into a groove 15 machined in the surface of the pick body.

Figure 2:
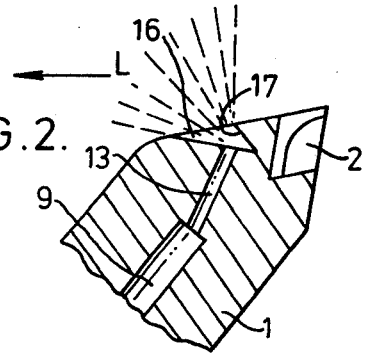
FIG. 2 is a scrap cross sectional side elevation of the forward end of a modified form of mineral mining pick.
Figure 3:
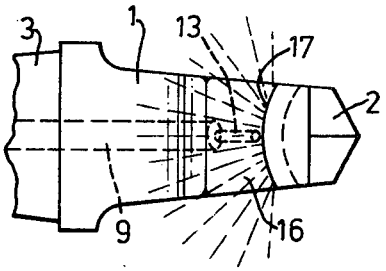
FIG. 3 is a plan view of the arrangement shown in FIG. 2.

In FIGS. 2 and 3 there is shown an arrangement generally similar to that described above except that the passage 13 emerges from the pick body behind the cutting tip 2 through one face of a generally V-shaped groove 16 such that the water impinges against the opposite face 17 of the groove and is deflected in the direction of the arrow L (FIG. 2) to facilitate formation of a spray.

Figure 4:
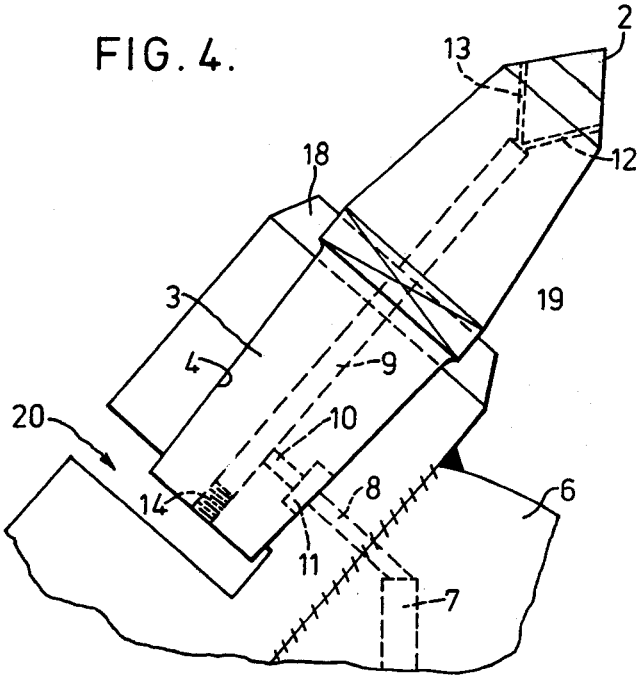
FIG. 4 is a view, generally similar to that of FIG. 1, of a modified form of mineral cutter pick.

In FIG. 4 of the drawings there is shown an embodiment of pick and holder which is generally similar to that shown in FIG. 1, except that here the pick has a forward end which is conical in shape and which is terminated by a pointed, conical hard cutter tip 2. Also the pick body is formed, at the junction between its forward end and its shank with an opposed pair of flat faces 19, only one of which is visible in the drawing, which are arranged to mate with and to be received in a slot 18 extending across the top of the holder 5. In this manner the pick is positively prevented from rotating in the holder in use. It will be noted that in this embodiment the arrangements for feeding water to the tip of the pick are the same as that described above with reference to FIG. 1. Thus water is fed to the tip of the pick via a bore which enters the pick through the side of the shank, the taper of the shank in the socket in the holder providing a water seal without the need for additional means.

I claim:

1. A mineral cutter pick adapted to be mounted on a mineral mining machine and to cut during translational movement in an endless path thereon, which pick comprises a body having a shank of circular cross section for accommodation in a correspondingly shaped recess on a support on a mineral cutting machine to mount the pick on the machine, said shank being adjacent its inner end not substantially less in diameter than at its outer end, the body having a forward end carrying a cutting tip and said body having a passage therethrough for liquid which passage leads from an inlet in the shank to a liquid outlet adjacent to the cutting tip, said pick body having a deflection surface adjacent to said liquid outlet, the arrangement being such that water issuing from said outlet impinges on the deflection surface so that the stream of water is deflected and the formation of a spray enhanced.

2. A mineral cutter pick according to claim 1, wherein the shank is tapered and is frusto-conical in shape.

3. A mineral cutter pick according to claim 1, wherein the water passage comprises a radial passage opening through the side wall of the shank.

4. A mineral cutter pick according to claim 3, wherein the radial passage in the shank has an enlarged portion where it emerges from the shank.

5. A mineral cutter pick according to claim 3, wherein the radial passage in the pick shank communicates with a longitudinally extending passage in the pick shank, which longitudinally extending passage extends into the vicinity of the cutting tip and from the forward end of which at least one passage is arranged to emerge through the body of the pick adjacent to the cutter tip.

6. A mineral cutter pick according to claim 5, wherein one passage is arranged to emerge from the pick body in front of the cutter tip and another passage is arranged to emerge from the pick body immediately behind the cutting tip.

7. A mineral cutter pick according to claim 1, wherein the liquid outlet emerges through a face of a groove formed in the pick body so that the stream of water impinges on an opposing face of the groove.

8. The combination of a mineral cutter pick as claimed in claim 1 and a holder therefor which is arranged such that when the socket of the pick is mounted in the holder the free end of the pick shank is accessible so as to facilitate removal of the pick from the holder.

9. A mineral cutter pick adapted to be mounted on a mineral mining machine and to cut during translational movement in an endless path thereon which pick comprises a body having a shank of cirular cross section for accommodation in a correspondingly shaped recess on a support on a mineral cutting machine to mount the pick on the machine, said shank being frusto-conical and being adjacent its inner end not substantially less in diameter than at its outer end, the body having a forward end carrying a cutting tip and said body having a passage therethrough for liquid which passage leads from an inlet opening through the side wall of the shank to at least one liquid outlet adjacent to the cutting tip, a groove in the body adjacent to the cutting tip and in which the liquid outlet is disposed and the liquid outlet emerging through one wall of the groove whereby a stream of liquid emerging from the liquid outlet impinges on the opposite wall of the groove and is thus deflected and the formation of a spray enhanced.

* * * * *